US008045717B2

(12) United States Patent
Chen et al.

(10) Patent No.: US 8,045,717 B2
(45) Date of Patent: Oct. 25, 2011

(54) STEREO DECODER AND METHOD FOR PROCESSING PILOT SIGNAL

(75) Inventors: Chieh Hung Chen, Kaohsiung (TW); Hsiang-Hui Chang, Taipei County (TW); Chih-Chien Huang, Yunlin County (TW)

(73) Assignee: Media Tek Inc., Hsinchu (TW)

( * ) Notice: Subject to any disclaimer, the term of this patent is extended or adjusted under 35 U.S.C. 154(b) by 1350 days.

(21) Appl. No.: 11/403,775

(22) Filed: Apr. 13, 2006

(65) Prior Publication Data

US 2007/0242831 A1 Oct. 18, 2007

(51) Int. Cl.
*H04H 20/47* (2008.01)

(52) U.S. Cl. ..... 381/2; 381/3; 381/6; 381/14; 381/15; 381/16; 455/205; 455/208

(58) Field of Classification Search ..... 381/2, 3, 381/6, 14–16; 455/205, 208
See application file for complete search history.

(56) References Cited

U.S. PATENT DOCUMENTS 4,493,099 A * 1/1985 Schmidt ..... 381/14
4,821,322 A 4/1989 Bose
5,202,924 A * 4/1993 Richards, Jr. ..... 381/13
5,966,400 A 10/1999 Den Braber
2003/0225583 A1* 12/2003 Fisher et al. ..... 704/500
2006/0104398 A1* 5/2006 Su et al. ..... 375/376

FOREIGN PATENT DOCUMENTS

CN 1148297 A 4/1997
EP 0 977 388 A1 2/2000

* cited by examiner

*Primary Examiner* — Xu Mei
*Assistant Examiner* — Paul Kim
(74) *Attorney, Agent, or Firm* — Patterson Thuente Christensen Pedersen, P.A.

(57) ABSTRACT

A stereo decoder and a method therefor are provided. The stereo decoder receives a MPX signal from an FM demodulator, and comprises a first auto-calibration circuit, a band-pass filter, a second auto-calibration circuit, a slicer and a PLL circuit. The first auto-calibration circuit generates a first control signal. The band-pass filter generates the pilot signal by filtering the MPX signal with a center frequency set by the first control signal. The second auto-calibration circuit generates a second control signal. The slicer converts the pilot signal into a square wave signal. The PLL circuit comprises a voltage controlled oscillator for generating an oscillation frequency in response to the second control signal. The PLL circuit receives the square wave signal to generate the reference signal around the predetermined frequency in response to the oscillation frequency.

15 Claims, 12 Drawing Sheets

STEREO DECODER AND METHOD FOR PROCESSING PILOT SIGNAL

CROSS-REFERENCES TO RELATED APPLICATIONS

Not applicable.

BACKGROUND OF THE INVENTION

1. Field of the Invention

The present invention relates to a stereo decoder and method for processing a pilot signal; more specifically, relates to a stereo decoder and method for processing pilot signal with an auto-calibration circuit.

2. Descriptions of the Related Art

For pilot detectors of the prior art, there is an FM demodulator used to demodulate a received signal to generate a multiplexed (MPX) signal which carries a pilot signal and an audio signal. The MPX signal's spectrum shows in FIG. 1. The MPX signal comprises a bandwidth of a summation of a left sound signal and aright sound signal (L+R) 100, the pilot signal 102, two bandwidths of subtraction of the left sound signal and the right sound signal (L−R) 104, 106, and a radio data system signal (RDS) 108. The pilot signal 102 for identifying that the audio signal is a mono signal or a stereo signal is modulated at a certain frequency. As FIG. 2 shows, a stereo decoder 2 of the prior art comprises a pilot signal processor 21, a de-emphasis filter 23. The pilot signal processor 21 is configured to retrieve a pilot signal out from a MPX signal. More particularly, the pilot signal processor 21 comprises a band-pass filter 201 with a center frequency of 19 kHz to filter the MPX signal so that the pilot signal can be retrieved. The pilot signal processor 21 further comprises a phase-locked loop (PLL) circuit 203 for synchronously processing the pilot signal to detect phase difference between the pilot signal and a reference signal. The de-emphasis filter 23 is configured to de-emphasize an audio signal, which is retrieved from the MPX signal, to generate a de-emphasis signal. The de-emphasis signal is a signal being low-passed by a first order low-pass filter of which the 3-dB frequency is around, for example, 2.122 KHz (US standard) or 3.183 KHz (Japan/Euro standard).

Both of the band-pass filter 201 and the PLL circuit 203 require passive components, e.g. networks 205 and 207, to set the center frequency of bandpass filter 201 and the loop bandwidth of PLL 203. The de-emphasis filter 23 also requires a filter capacitor, e.g. a network 209. These networks 205, 207, 209 are implanted on a printed circuit board and connected to the chip of the stereo decoder 2. In other words, the networks 205, 207, 209 are not integrated in the chip of the stereo decoder 2. Such external components occupy too much space and increase cost.

Accordingly, a solution of integrating a pilot detector and filter capacitors/resistors is desired in the industrial field.

SUMMARY OF THE INVENTION

One object of this invention is to provide a stereo decoder for receiving a MPX signal from an FM demodulator to generate a pilot signal. The stereo decoder comprises an auto-calibration circuit and a band-pass filter. The auto-calibration circuit generates a control signal. The band-pass filter generates the pilot signal by filtering the MPX signal with a center frequency set by the control signal.

Another object of this invention is to provide a stereo decoder for generating a reference signal around a predetermined frequency based on a pilot signal. The stereo decoder comprises an auto-calibration circuit, a slicer and a PLL circuit. The auto-calibration circuit generates a control signal. The slicer converts the pilot signal into a square wave signal. The PLL circuit comprises a voltage controlled oscillator for generating an oscillation frequency in response to the control signal. The PLL circuit receives the square wave signal to generate the reference signal around the predetermined frequency in response to the oscillation frequency.

Another object of this invention is to provide a stereo decoder for generating a reference signal around a predetermined frequency. The stereo decoder receives a MPX signal from an FM demodulator, and comprises a first auto-calibration circuit, a band-pass filter, a second auto-calibration circuit, a slicer and a PLL circuit. The first auto-calibration circuit generates a first control signal. The band-pass filter generates the pilot signal by filtering the MPX signal with a center frequency set by the first control signal. The second auto-calibration circuit generates a second control signal. The slicer converts the pilot signal into a square wave signal. The PLL circuit comprises a voltage controlled oscillator for generating an oscillation frequency in response to the second control signal. The PLL circuit receives the square wave signal to generate the reference signal around the predetermined frequency in response to the oscillation frequency.

Another object of this invention is to provide a method for generating a pilot signal based on a MPX signal. The method comprises the following steps: providing an auto-calibration circuit to generate a control signal; setting a center frequency in response to the control signal; and filtering the MPX signal with the center frequency to generate the pilot signal.

Another object of this invention is to provide a method for generating a reference signal around a predetermined frequency based on a pilot signal. The method comprises the following steps: providing an auto-calibration circuit to generate a control signal; converting the pilot signal into a square wave signal; generating an oscillation frequency in response to the control signal; and generating the reference signal around the predetermined frequency in response to the oscillation frequency.

Another object of this invention is to provide a method for generating a reference signal around a predetermined frequency based on a MPX signal. The method comprises the following steps: receiving the MPX signal; providing a first auto-calibration circuit to generate a first control signal; setting a center frequency in response to the first control signal; filtering the MPX signal with the center frequency to generate the pilot signal; providing a second auto-calibration circuit to generate a second control signal; converting the pilot signal into a square wave signal; generating an oscillation frequency in response to the second control signal; and generating the reference signal around the predetermined frequency in response to the oscillation frequency.

Another object of this invention is to provide a stereo decoder. The stereo decoder comprises a pilot signal generator, a multiplexer and an audio signal processor. The pilot signal generator, comprising an auto-calibration circuit to generate a control signal, receives the MPX signal to generate a reference signal in response to the control signal. The multiplexer receives the MPX signal to generate an audio signal in response to the reference signal. The audio signal processor de-emphasizes the audio signal.

Another object of this invention is to provide a stereo decoder for generating a pilot signal. The stereo decoder receives a MPX signal from an FM demodulator. The stereo decoder comprises means for generating a control signal; means for setting a center frequency in response to the control signal; and means for filtering the MPX signal to generate the pilot signal in response to the center frequency.

Another object of this invention is to provide a stereo decoder for generating a reference signal around a predetermined frequency based on a pilot signal. The stereo decoder comprises means for generating a control signal; means for converting the pilot signal into a square wave signal; means for generating an oscillation frequency in response to the control signal; and means for generating the reference signal around the predetermined frequency in response to the oscillation frequency.

Another object of this invention is to provide a stereo decoder for generating a reference signal around a predetermined frequency based on a MPX signal. The stereo decoder comprises means for receiving the MPX signal; means for generating a first control signal; means for setting a center frequency in response to the first control signal; means for filtering the MPX signal with the center frequency to generate the pilot signal; means for generating a second control signal; means for converting the pilot signal into a square wave signal; means for generating an oscillation frequency in response to the second control signal; and means for generating the reference signal around the predetermined frequency in response to the oscillation frequency.

The present invention integrates the above-mentioned auto-calibration circuit into stereo decoders in order to remove external passive components. The integration saves cost and space of a system where the present invention applies.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
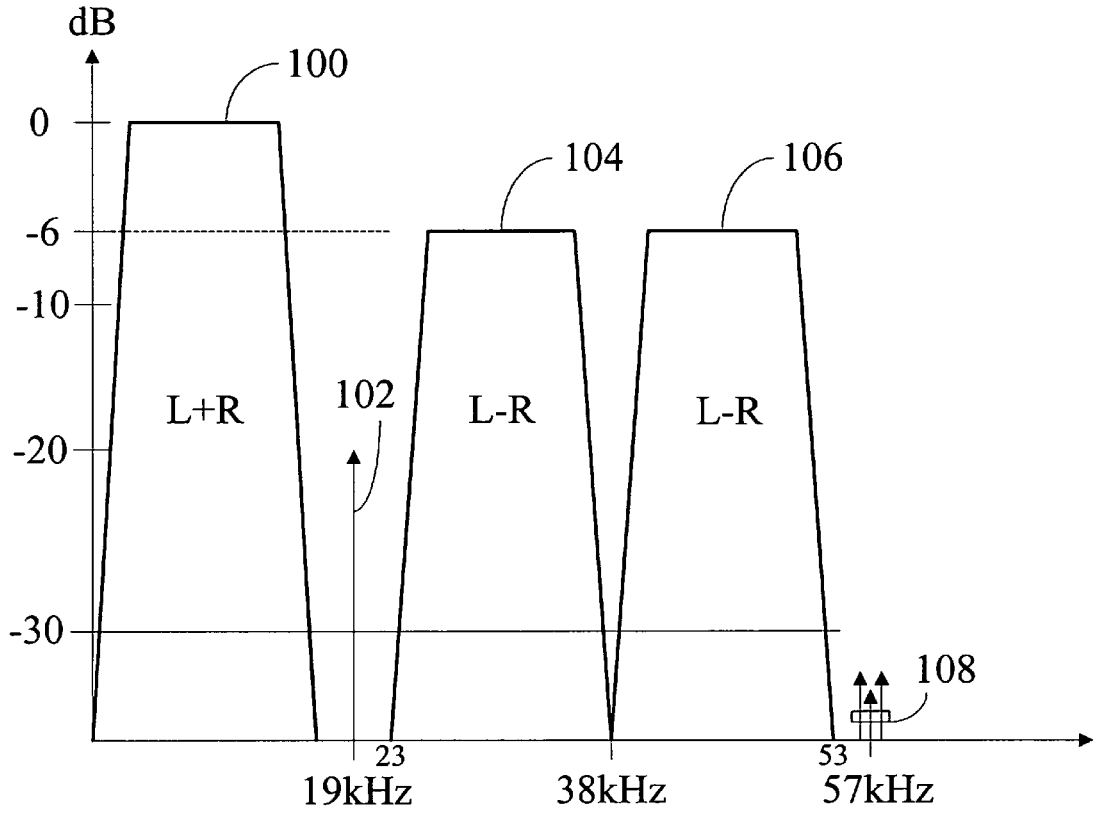
FIG. 1 is a signal diagram of a MPX signal of the related art.
Figure 2:
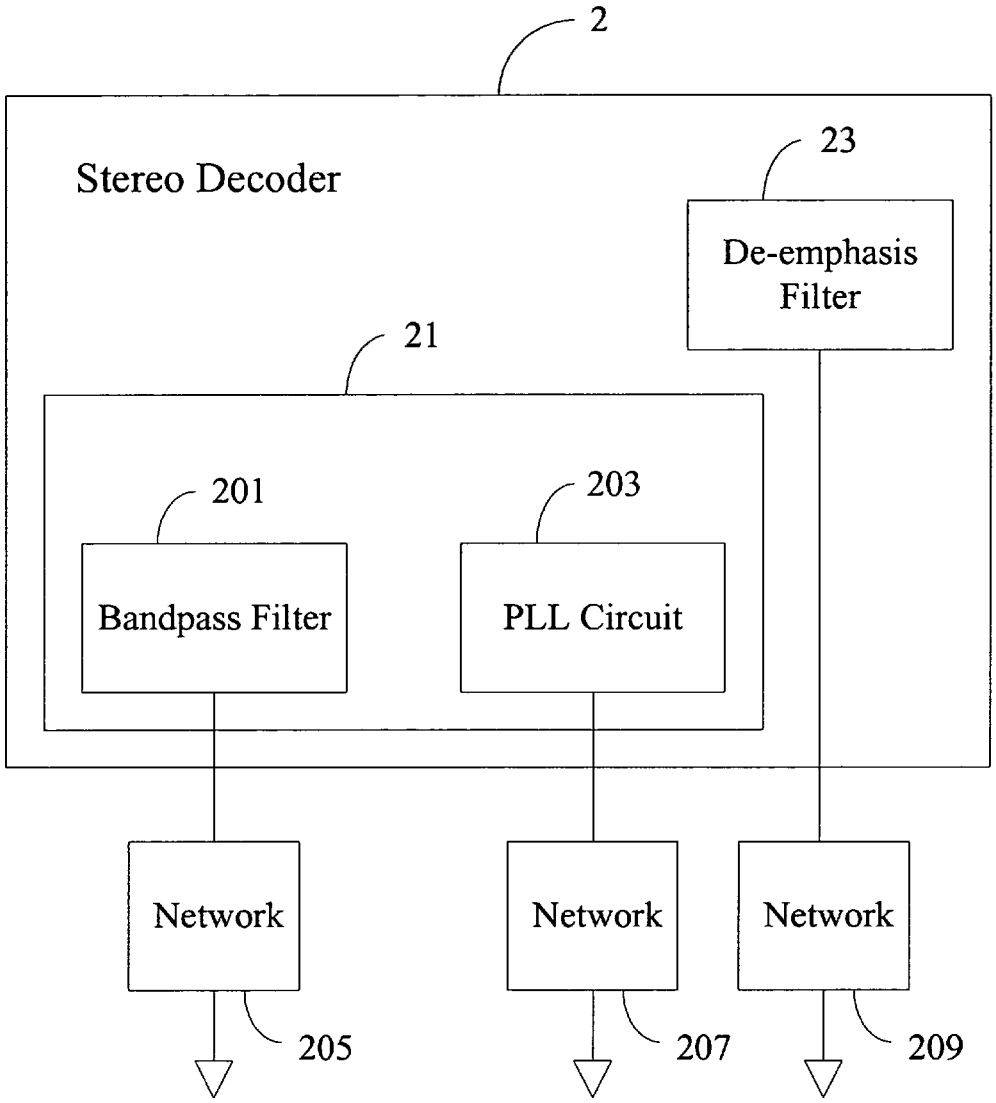
FIG. 2 is a block diagram of a stereo decoder of the related art.
Figure 3:
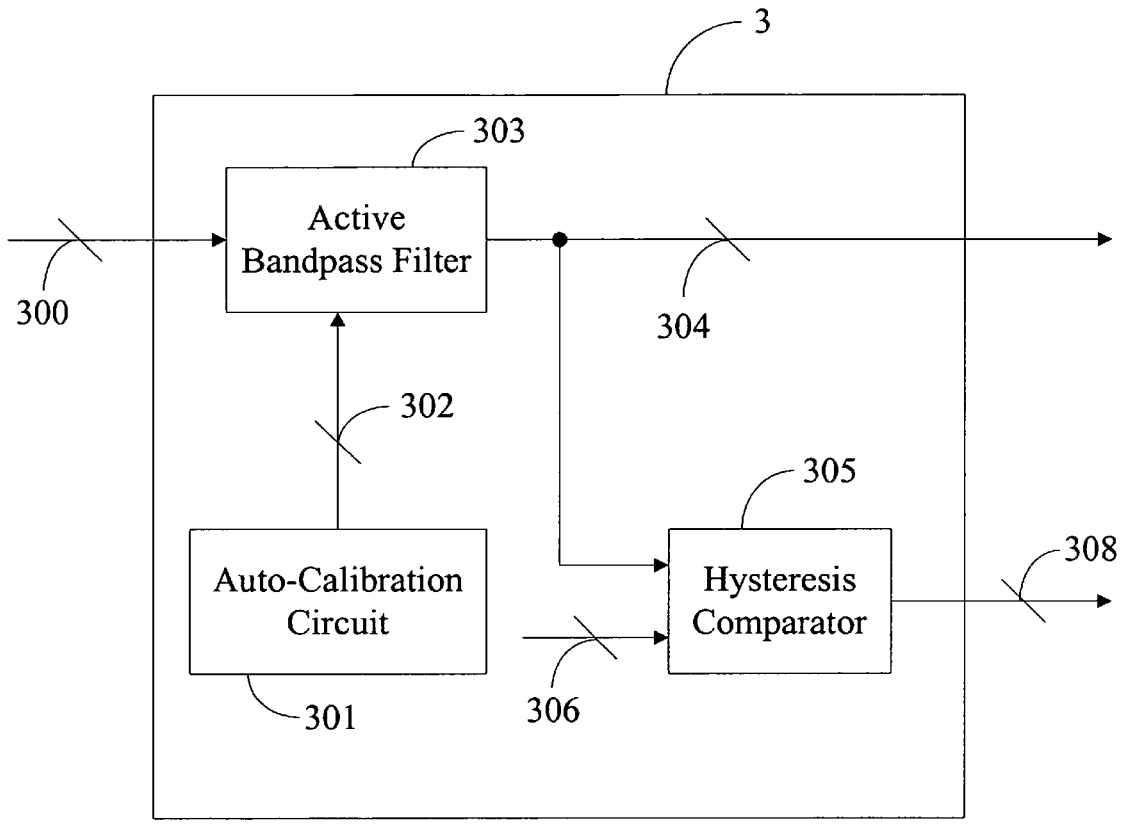
FIG. 3 is a block diagram of a first embodiment of the present invention.

A first embodiment of the present invention is a stereo decoder for generating a pilot signal. The first embodiment is applied to an FM receiver. As shown in FIG. 3, the stereo decoder 3, receiving a MPX signal 300 from a previous stage which is an FM demodulator, comprises an auto-calibration circuit 301, an active band-pass filter 303, and a hysteresis comparator 305. The active band-pass filter 303 may be a switched capacitor filter with a center frequency of 19 kHz. To retrieve the pilot signal correctly, a high quality factor for the active band-pass filter 303 is required. However, the high quality factor results in a group-delay of the active band-pass filter 303 being sensitive to the variances of practical semiconductor manufacture and the environment temperature. Such a group-delay influences the separation of right and left sound tracks. The auto-calibration circuit 301 is configured to generate a control signal 302 to set the center frequency in order to solve the problem of the group-delay. The active band-pass filter 303 filters the MPX signal 300 to generate the pilot signal 304 with the center frequency of around 19 KHz set by the control signal 302.

The hysteresis comparator 305 is configured to generate a digital signal 308 after comparing the pilot signal 304 and a threshold signal 306, wherein the digital signal 308 indicates a signal type of the MPX signal 300. If a peak value of the pilot signal 304 is larger than that of the threshold 306, the digital signal 308 is, for example, a high level which represents that the signal type is stereo. Otherwise, a low level of the digital signal 308 represents that the signal type is mono. The FM receiver decodes the MPX signal 300 in response to the signal type thereby.

Figure 4:
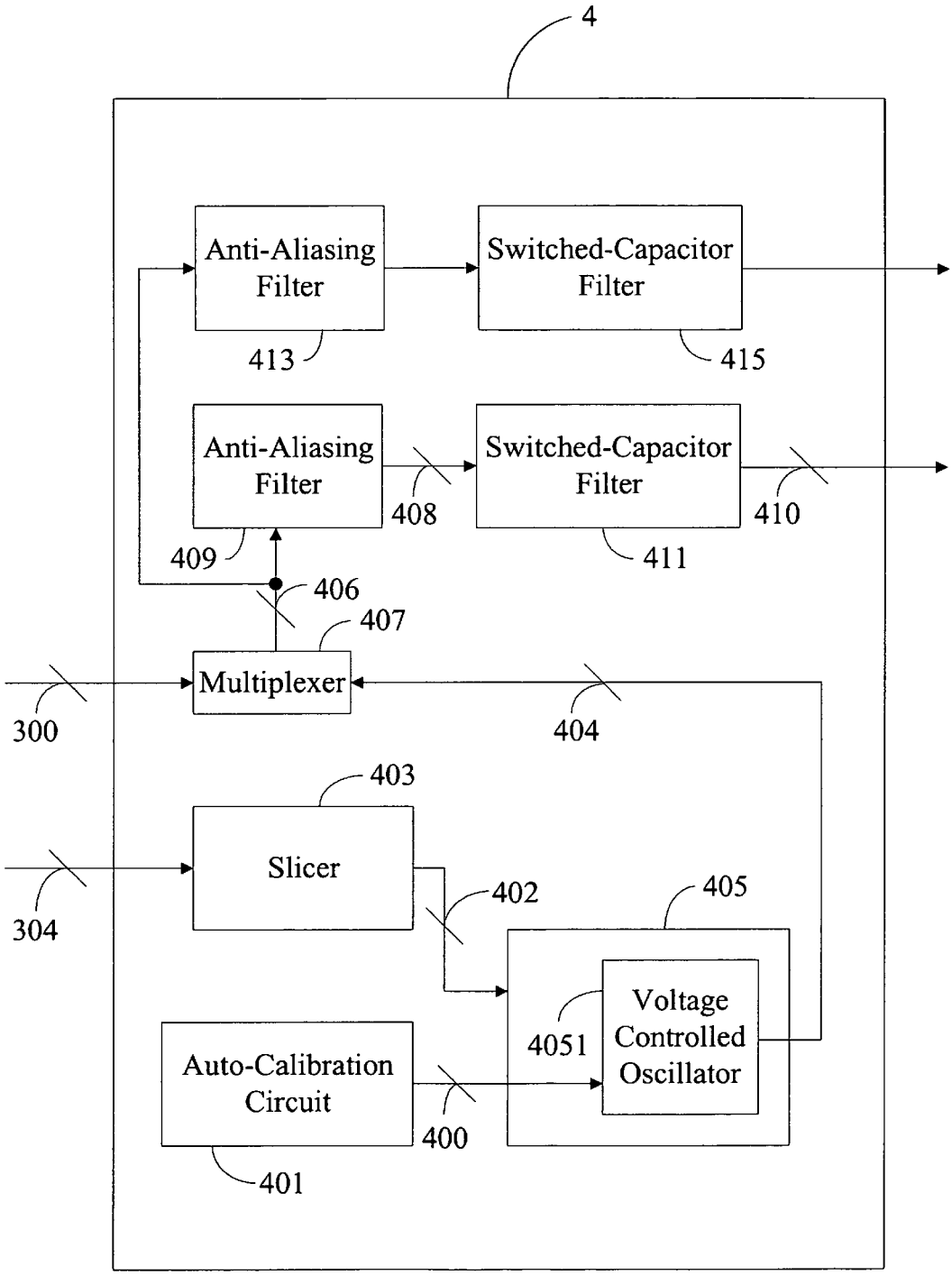
FIG. 4 is a block diagram of a second embodiment of the present invention.

A second embodiment of the present invention is a stereo decoder 4 for generating a reference signal 404 based on the pilot signal 304 as shown in FIG. 4. The reference signal 404 is used to perform the separation of sound tracks. To perform the separation of sound tracks, a predetermined frequency of the reference signal 404 should be twice larger than the frequency of the pilot signal 304, i.e. 38 KHz. The stereo decoder 4 comprises an auto-calibration circuit 401, a slicer 403 and a PLL circuit 405. To lock phase successfully, the PLL circuit 405 requires a fixed oscillation frequency, such as a multiple of 38 kHz in this case. However, the oscillation frequency is sensitive to the variances of practical semiconductor manufacture. Once the variances occur, the phase-lock might fail so that the separation of right and left sound tracks is influenced due to the phase difference of the pilot signal 304 between the transmitter and the receiver. The auto-calibration circuit 401 is configured to generate a control signal 400 to fix the oscillation frequency around the multiple of 38 KHz. The slicer 403 converts the pilot signal 304 into a square wave signal 402. The PLL circuit 405 comprises a voltage controlled oscillator 4051. The voltage controlled oscillator 4051 is configured to generate the oscillation frequency of the multiple of 38 KHz in response to the control signal 400. The PLL circuit 405 receives the square wave 402 and generates the reference signal 404 around 38 KHz in response to the oscillation frequency of the voltage controlled oscillator 4051.

The stereo decoder 4 further comprises a multiplexer 407, two anti-aliasing filters 409, 413 and two switched-capacitor filters 411, 415. The stereo decoder 4 retrieves an audio signal 406 from the MPX signal 300 in response to the reference signal 404. More particularly, the multiplexer 407 is configured to retrieve the audio signal 406 from the MPX signal 300 in response to the reference signal 404. Before the retrieval, the MPX signal 300 may be filtered by a low-pass filter (not shown) to remove high frequency noise. The anti-aliasing filter 409 and the switched-capacitor filter 411 are configured for signal processing of the left sound track. The anti-aliasing filter 413 and the switched-capacitor filter 415 are configured for signal processing of the right sound track. The anti-aliasing filter 409 is configured to anti-alias the audio signal 406 to generate an anti-aliased audio signal 408. For the sake of simplicity, an operating frequency of the switched-capacitor filter 411 is set at the multiple of 38 KHz as well and derived from the voltage controlled oscillator 4051. The switched-capacitor filter 411 is configured to de-emphasize the anti-aliased audio signal 408 to obtain a left sound signal 410. The left sound signal 410 is outputted to a speaker after amplified. The operations of the anti-aliasing filter 413 and the switched-capacitor filter 415 are similar to the operations of the anti-aliasing filter 409 and the switched-capacitor filter 411.

Figure 5:
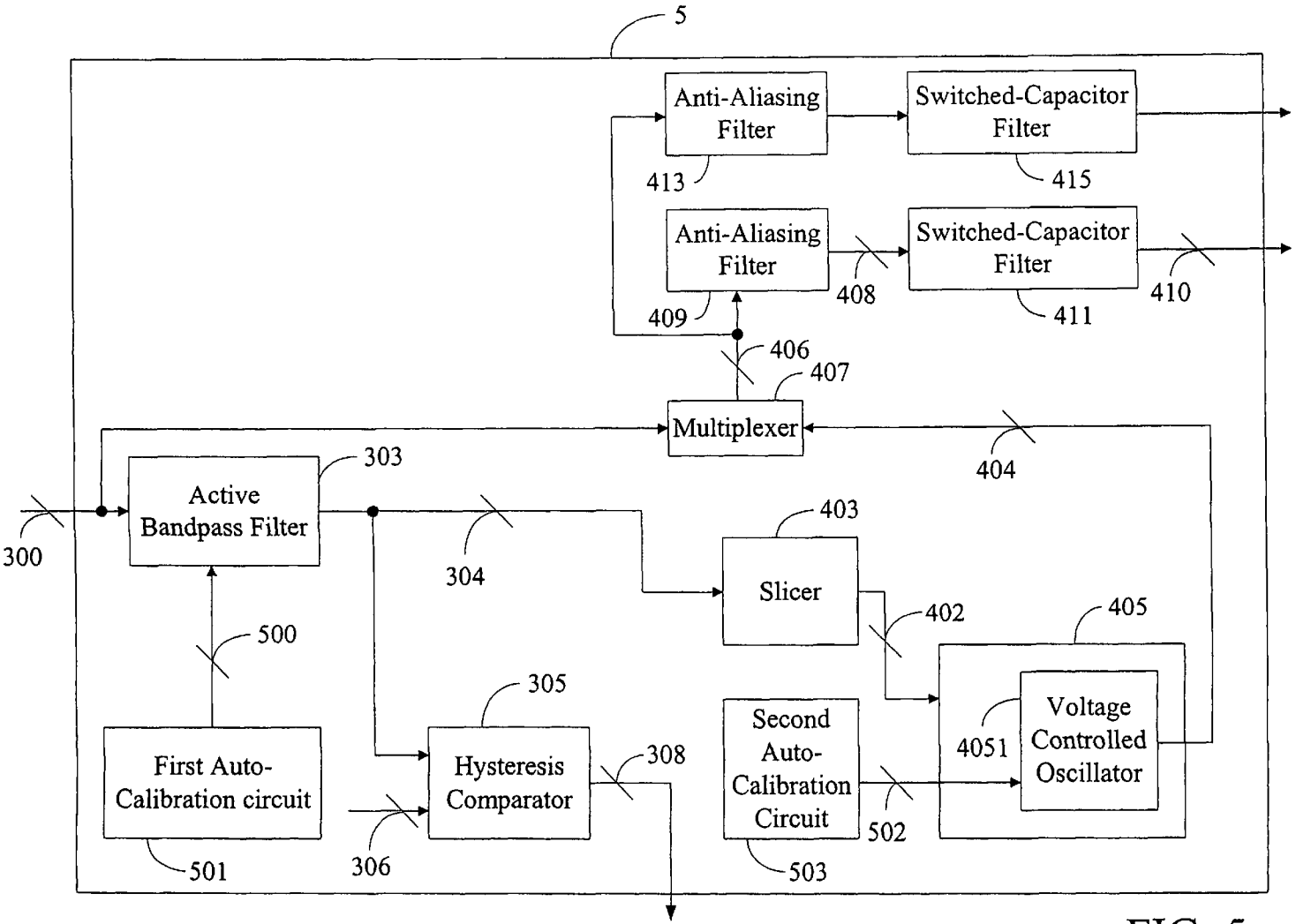
FIG. 5 is a block diagram of a third embodiment of the present invention.

A third embodiment of the present invention is a stereo decoder 5 which integrates all of the elements of the first embodiment and the second as shown in FIG. 5. To identify each element, the auto-calibration circuit 301 is renamed as a first auto calibration circuit 501 in the third embodiment, the control signal 302 is renamed as a first control signal 500 in the third embodiment, the auto calibration circuit 401 is renamed as a second auto-calibration circuit 503 in the third embodiment, and the control signal 400 is renamed as a second control signal 502 in the third embodiment. The operation of each element of the third embodiment is similar to that of the identical element in the first embodiment or the second embodiment.

Figure 6:
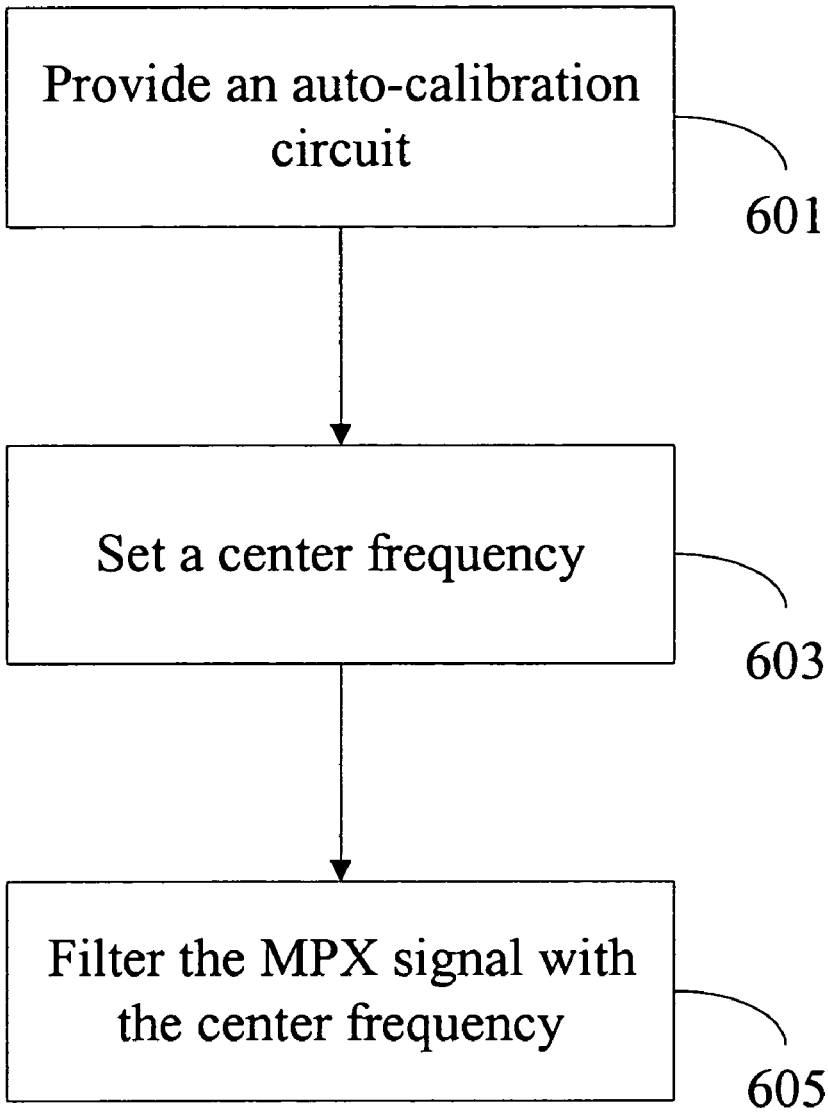
FIG. 6 is a flow chart of a fourth embodiment of the present invention.

A fourth embodiment of the present invention is a method for a stereo decoder to generate a pilot signal based on a MPX signal. The fourth embodiment corresponds to the first embodiment. As shown in FIG. 6, the fourth embodiment comprises the following steps. In step 601, the stereo decoder provides an auto-calibration circuit, such as the auto-calibration circuit 301, to generate a control signal. In step 603, a filter of the stereo decoder, such as the active band-pass filter 303, sets a center frequency in response to the control signal. In step 605, the filter filters the MPX signal with the center frequency to generate the pilot signal. As mentioned above, the center frequency is set at 19 KHz.

Figure 7:
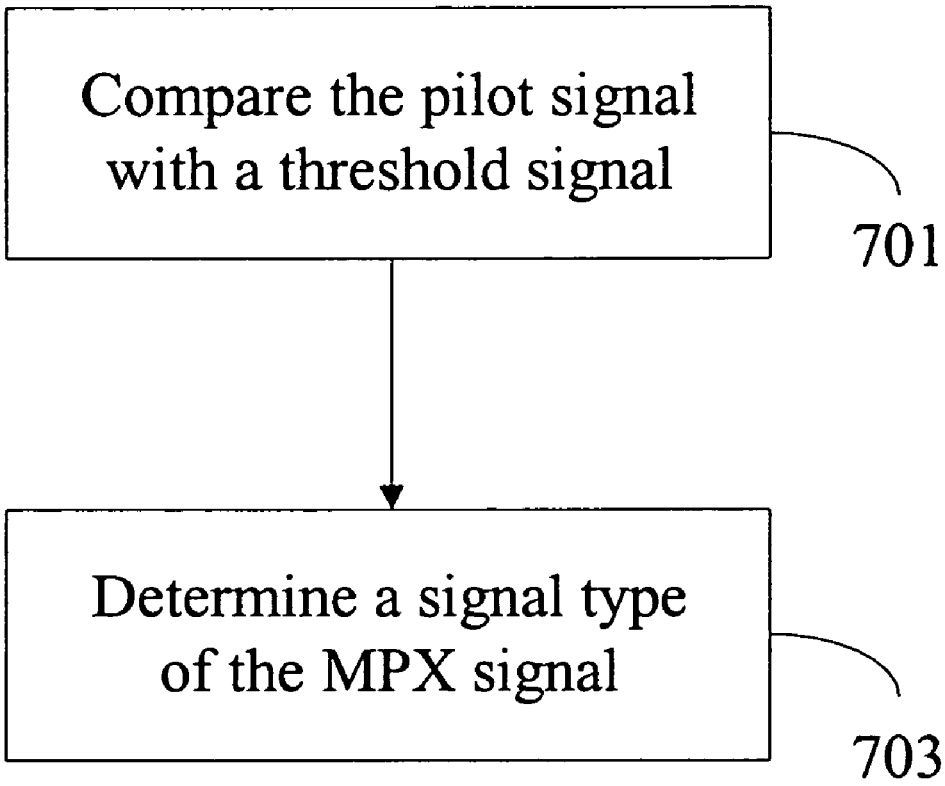
FIG. 7 is a flow chart of determining a signal type of a MPX signal of the forth embodiment.

The fourth embodiment further comprises the following steps as shown in FIG. 7. In step 701, a hysteresis comparator of the stereo decoder, such as the hysteresis comparator 305, compares the pilot signal with a threshold signal. In step 703, a signal type of the MPX signal is determined based on the comparison.

Figure 8:
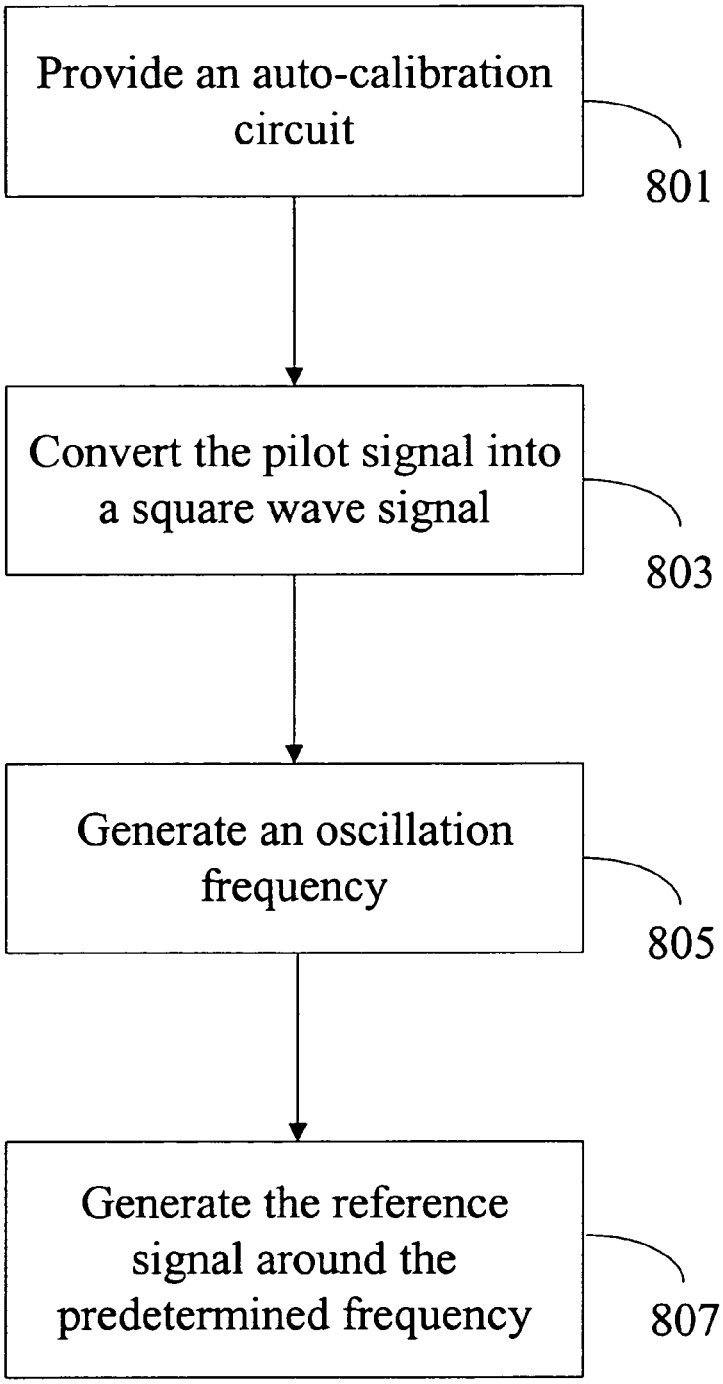
FIG. 8 is a flow chart of a fifth embodiment of the present invention.

A fifth embodiment of the present invention is a method for a stereo decoder to generate a reference signal around a predetermined frequency based on a pilot signal. The fifth embodiment corresponds to the second embodiment. As shown in FIG. 8, the fifth embodiment comprises the following steps. In step 801, the stereo decoder provides an auto-calibration circuit, such as the auto-calibration circuit 401, to generate a control signal. In step 803, a slicer of the stereo decoder, such as the slicer 403, converts the pilot signal into a square wave signal. In step 805, a voltage controlled oscillator of the stereo decoder, such as the voltage controlled oscillator 4051, generates an oscillation frequency in response to the control signal. In step 807, a PLL circuit, such as the PLL circuit 405, generates the reference signal around 38 KHz in response to the oscillation frequency.

Figure 9:
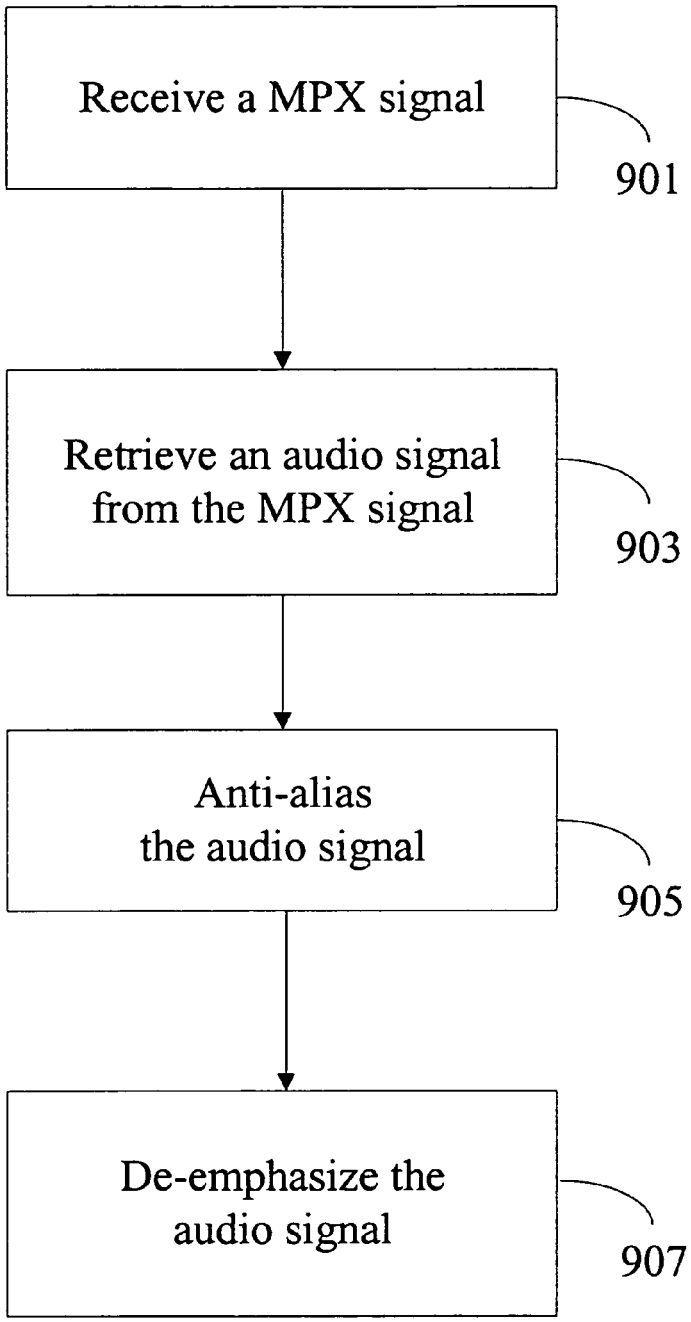
FIG. 9 is a flow chart of processing an audio signal of the fifth embodiment.

As shown in FIG. 9, the fifth embodiment further comprises the following steps. In step 901, the stereo decoder receives a MPX signal. In step 903, the stereo decoder retrieves an audio signal from the MPX signal in response to the reference signal. In step 905, an anti-aliasing filter of the stereo decoder, such as the anti-aliasing filter 409 or 413, anti-aliases the audio signal. In step 907, a switched-capacitor filter of the stereo decoder, such as the switched-capacitor filter 411 or 415, de-emphasizes the audio signal.

Figure 10:
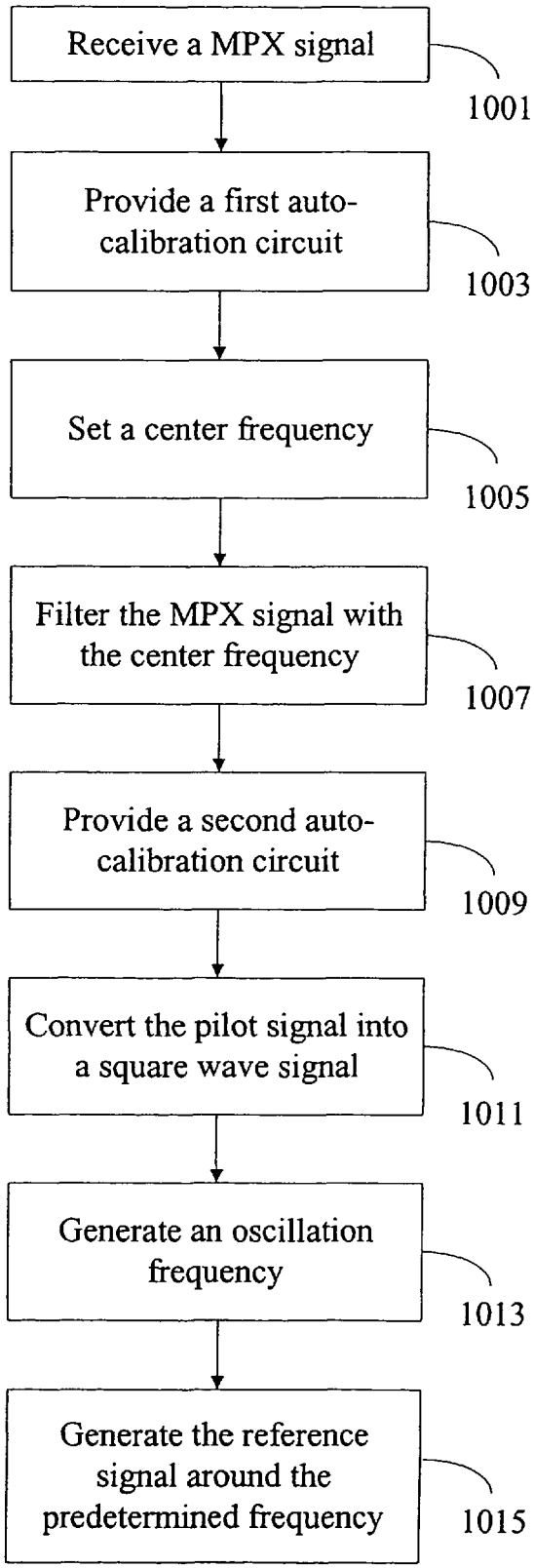
FIG. 10 is a flow chart of a sixth embodiment of the present invention.

A sixth embodiment of the present invention is a method for a stereo decoder to generate a reference signal around a predetermined frequency based on a MPX signal. The sixth embodiment corresponds to the third embodiment. The steps of the sixth embodiment are shown in FIG. 10. In step 1001, the stereo decoder receives the MPX signal, such as the MPX signal 300. In step 1003, the stereo decoder provides a first auto calibration circuit, such as the first auto-calibration circuit 501, to generate a first control signal. In step 1005, a filter of the stereo decoder, such as the active band-pass filter 303, sets a center frequency in response to the first control signal. In step 1007, the filter filters the MPX signal with the center frequency to generate a pilot signal, such as the pilot signal 304. In step 1009, the stereo decoder provides a second auto calibration circuit, such as the second auto-calibration circuit 503, to generate a second control signal. In step 1011, a slicer of the stereo decoder, such as the slicer 403, converts the pilot signal into a square wave signal. In step 1013, a voltage controlled oscillator of the stereo decoder, such as the voltage controlled oscillator 4051, generates an oscillation frequency in response to the second control signal. In step 1015, a PLL circuit of the stereo decoder, such as the PLL circuit 405, generates the reference signal around the predetermined frequency, 38 KHz, in response to the oscillation frequency.

Figure 11:
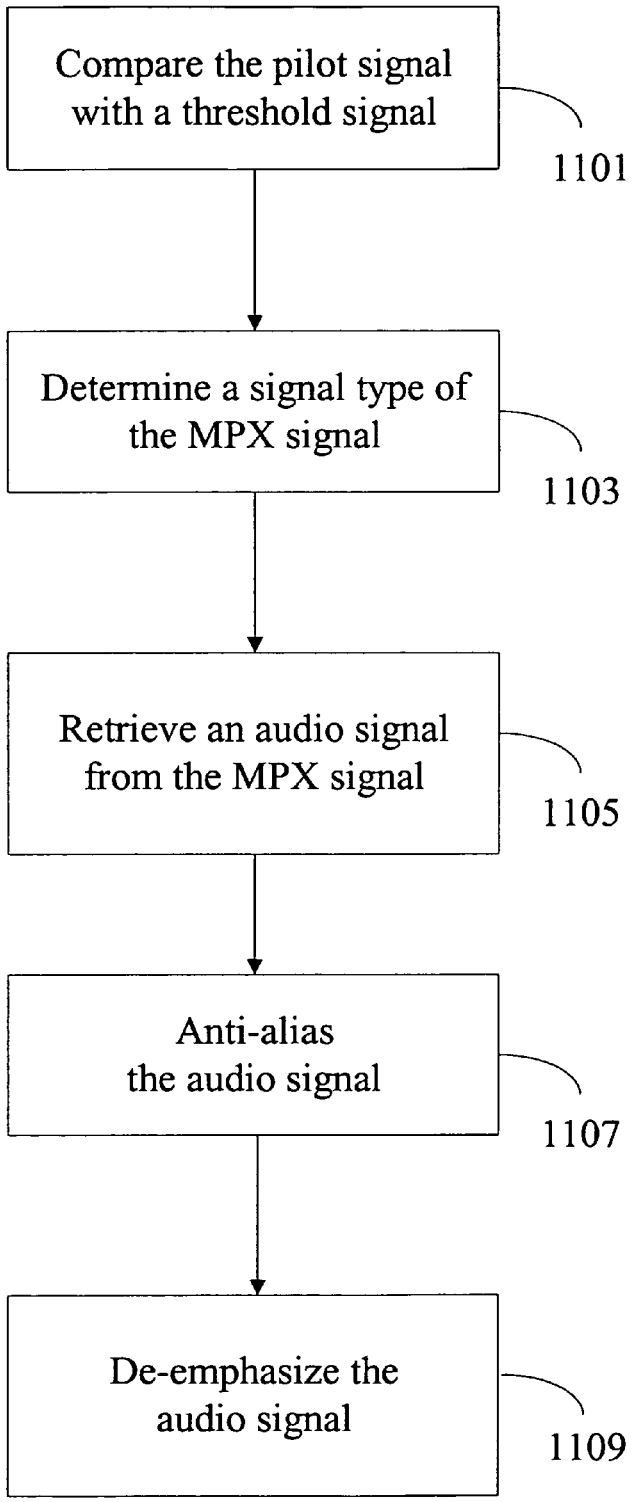
FIG. 11 is a flow chart of processing an audio signal of the sixth embodiment.

The sixth embodiment further comprises the following steps as shown in FIG. 11. In step 1101, a hysteresis comparator of the stereo decoder, such as the hysteresis comparator 305, compares the pilot signal with a threshold signal. In step 1103, the stereo decoder determines a signal type of the MPX signal based on the comparison, wherein the signal type is either stereo or mono. In step 1105, a multiplexer of the stereo decoder, such as the multiplexer 407, retrieves an audio signal from the MPX signal in response to the reference signal. In step 1107, an anti-aliasing filter of the stereo decoder, such as the anti-aliasing filter 409 or 413, anti-aliases the audio signal. In step 1109, a switched-capacitor filter of the stereo decoder, such as the switched-capacitor filters 411 or 415, de-emphasizes the audio signal after anti-aliasing.

Figure 12:
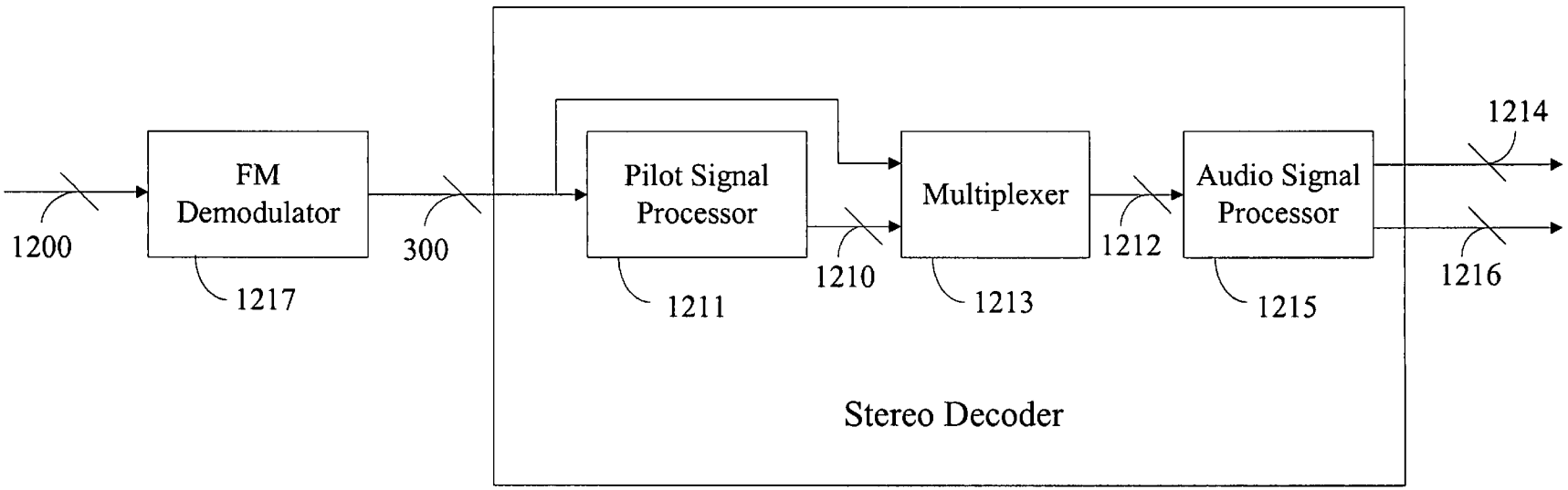
FIG. 12 is a block diagram of a seventh embodiment of the present invention.

A seventh embodiment of the present invention comprises an FM demodulator 1217, a stereo decoder 1211, a multiplexer 1213 and an audio signal processor 1215 as shown in FIG. 12. The FM demodulator 1217 is configured to generate a MPX signal 300 in response to an FM signal 1200. The pilot signal generator 1211 comprises an auto-calibration circuit, a slicer, a PLL circuit, and an active bandpass filter of which the operations have already mentioned above. The pilot signal generator 1211 receives the MPX signal 300 and generates a reference signal 1210, like the reference signal 404, around 38 KHz in response to the control signal generated by the auto-calibration circuit. The multiplexer 1213, such as the multiplexer 407, receives the MPX signal 300 and generates an audio signal 1212, such as the audio signal 406, in response to the reference signal 1210. The audio signal processor 1215 comprises two pairs of an anti-aliasing filter and a switched-capacitor filter of which the operations have been mentioned above. After the audio signal processor 1215 de-emphasizes the audio signal 1212, one pair outputs a first sound signal 1214 for the left sound track and the other pair outputs a second sound signal 1216 for the fight sound track. Both of the first sound signal 1214 and the second sound signal 1216 are transmitted to speakers.

The stereo decoder of the present invention do not need external components, like filter capacitors and resisters, to maintain their normal functionality by integrating an auto-calibration circuit and/or a switched capacitor filter. Cost and space of the electronic devices using the present invention is effectively reduced.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A stereo decoder for generating a reference signal around a predetermined frequency based on a pilot signal, comprising:

a first auto-calibration circuit for generating a first control signal;

a slicer for converting the pilot signal into a square wave signal; and a phase-locked loop (PLL) circuit comprising a voltage controlled oscillator for generating an oscillation frequency in response to the first control signal;

wherein the PLL circuit receives the square wave signal directly to generate the reference signal around the predetermined frequency in response to the oscillation frequency.

2. The stereo decoder as claimed in claim 1, the stereo decoder retrieving an audio signal from a MPX signal sent by an FM demodulator in response to the reference signal, the stereo decoder further comprising:

an anti-aliasing filter for anti-aliasing the audio signal; and a switched-capacitor filter for de-emphasizing the audio signal after anti-aliasing.

3. The stereo decoder as claimed in claim 1, further receiving a MPX signal from an FM demodulator, and comprising:

a second auto-calibration circuit for generating a second control signal; and a band-pass filter generating the pilot signal by filtering the MPX signal with a center frequency set by the second control signal.

4. The stereo decoder as claimed in claim 3, further comprising a hysteresis comparator for receiving and comparing the pilot signal with a threshold signal to determine a signal type of the MPX signal.

5. The stereo decoder as claimed in claim 3, the stereo decoder retrieving an audio signal from the MPX signal in response to the reference signal, the stereo decoder further comprising:

an anti-aliasing filter for anti-aliasing the audio signal; and a switched-capacitor filter for de-emphasizing the audio signal after anti-aliasing.

6. A method for generating a reference signal around a predetermined frequency based on a pilot signal, comprising the steps of:

providing a first auto-calibration circuit to generate a first control signal;

providing a slicer to convert the pilot signal into a square wave signal;

providing a phase-locked loop (PLL) circuit to generate an oscillation frequency in response to the first control signal; and enabling the PLL circuit to receive the square wave signal directly to generate the reference signal around the predetermined frequency in response to the oscillation frequency.

7. The method as claimed in claim 6, further comprising the steps of:

receiving a MPX signal;

retrieving an audio signal from the MPX signal in response to the reference signal;

anti-aliasing the audio signal; and de-emphasizing the audio signal after anti-aliasing.

8. The method as claimed in claim 6, further comprising the steps of:

receiving a MPX signal;

providing a second auto-calibration circuit to generate a second control signal;

setting a center frequency in response to the second control signal; and filtering the MPX signal with the center frequency to generate the pilot signal.

9. The method as claimed in claim 8, further comprising the steps of:

comparing the pilot signal with a threshold signal; and determining a signal type of the MPX signal based on the comparison.

10. The method as claimed in claim 8, further comprising the steps of:

retrieving an audio signal from the MPX signal in response to the reference signal;

anti-aliasing the audio signal; and de-emphasizing the audio signal after anti-aliasing.

11. An FM receiver, comprising:

an FM demodulator for generating a MPX signal in response to an FM signal;

a stereo decoder, comprising an auto-calibration circuit to generate a control signal, for receiving the MPX signal to generate a reference signal in response to the control signal;

a multiplexer for receiving the MPX signal to generate an audio signal in response to the reference signal; and an audio signal processor for de-emphasizing the audio signal.

12. The FM receiver as claimed in claim 11, the stereo decoder further comprising a band-pass filter for filtering the MPX signal with a center frequency set by the control signal.

13. The FM receiver as claimed in claim 11, the audio signal processor further comprising:

an anti-aliasing filter for anti-aliasing the audio signal; and a switched-capacitor filter for de-emphasizing the audio signal after anti-aliasing.

14. A stereo decoder for generating a reference signal around a predetermined frequency based on a pilot signal, comprising:

means for generating a first control signal;

means for converting the pilot signal into a square wave signal;

means for receiving the square wave signal directly to generate an oscillation frequency in response to the first control signal; and means for generating the reference signal around the predetermined frequency in response to the oscillation frequency.

15. The stereo decoder of claim 14, further comprising:

means for receiving an MPX signal;

means for generating a second control signal;

means for setting a center frequency in response to the second control signal;

means for filtering the MPX signal with the center frequency to generate the pilot signal.

* * * * *